United States Patent [19]

Thrower et al.

[11] Patent Number: 4,944,496

[45] Date of Patent: Jul. 31, 1990

[54] APPARATUS FOR INJECTING GAS INTO HIGH TEMPERATURE LIQUIDS, E.G. MOLTEN METALS

[75] Inventors: Anthony Thrower, Dronfield Woodhouse; John R. Gelsthorpe, Sheffield, both of England

[73] Assignee: Injectall Limited, Sheffield, England

[21] Appl. No.: 274,528

[22] PCT Filed: Apr. 8, 1988

[86] PCT No.: PCT/GB88/00271

§ 371 Date: Dec. 29, 1988

§ 102(e) Date: Dec. 29, 1988

[87] PCT Pub. No.: WO88/08041

PCT Pub. Date: Oct. 20, 1988

[30] Foreign Application Priority Data

Apr. 10, 1987 [GB] United Kingdom ..... 8708673
Jan. 22, 1988 [GB] United Kingdom ..... 8801455

[51] Int. Cl.[5] ..... C21C 5/34

[52] U.S. Cl. ..... 266/220; 266/218; 266/270

[58] Field of Search ..... 266/218, 220, 265, 266, 266/270, 287

[56] References Cited

U.S. PATENT DOCUMENTS

| | | | |
|---|---|---|---|
| 3,373,986 | 3/1968 | Spire | 266/220 |
| 3,971,548 | 7/1976 | Folgero et al. | 266/218 |
| 4,575,393 | 3/1986 | Bates et al. | 75/53 |
| 4,742,995 | 5/1988 | Bates | 266/270 |
| 4,789,141 | 12/1988 | Bates et al. | 266/218 |
| 4,802,655 | 2/1989 | Bates | 266/218 |
| 4,824,079 | 4/1989 | King | 266/270 |

FOREIGN PATENT DOCUMENTS

| | | |
|---|---|---|
| 0186852 | 7/1986 | European Pat. Off. . |
| 3115108 | 10/1982 | Fed. Rep. of Germany . |
| 3523171 | 10/1986 | Fed. Rep. of Germany . |
| 2451945 | 10/1980 | France . |
| 60-86206 | 5/1985 | Japan . |
| 1594631 | 8/1981 | United Kingdom . |
| 2094954 | 9/1982 | United Kingdom . |
| 2150868 | 7/1985 | United Kingdom . |
| 2177485 | 1/1987 | United Kingdom . |
| 86/00695 | 1/1986 | World Int. Prop. O. . |

OTHER PUBLICATIONS

Radex-Rundschau, Heft 3, 1983, B. Grabner et al., pp. 179-209.

*Primary Examiner*—S. Kastler
*Attorney, Agent, or Firm*—Buchanan Ingersol

[57] ABSTRACT

An injection nozzle for installation in the wall of a vessel for introducing gas into a liquid in the vessel. The nozzle comprises a body pierced by a passage which is terminated at the discharge end of the nozzle by a gas-porous or foraminous passage-closing means. Means is provided gas-tightly affixed to the closing means to feed gas thereto. The gas-feeding means includes a duct structure which extends along the passage between the closing means and the inlet end of the body. The duct structure provides a substantially leak-tight gas-feed path from an external gas delivery means to the passage-closing means. The duct structure can be adjustable or extensible in length.

43 Claims, 7 Drawing Sheets

APPARATUS FOR INJECTING GAS INTO HIGH TEMPERATURE LIQUIDS, E.G. MOLTEN METALS

Figure 1:
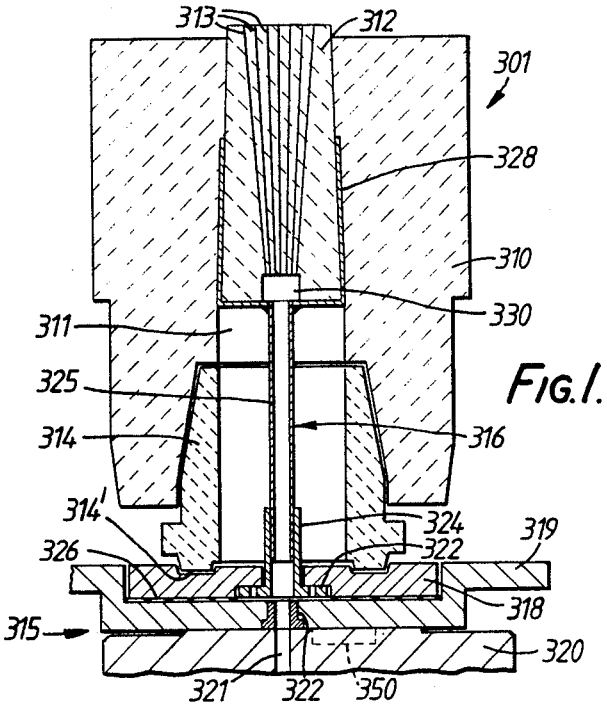

The invention relates to devices and apparatus for injecting gas into high temperature liquids, e.g. molten metals.

It may often be necessary to introduce gas into molten metal in a container or vessel. Gas is injected, for instance into the bottom area of a vessel for diverse purposes, including rinsing; clearing the relatively cool bottom area of solidification products, to help remove them from the vicinity of the vessel bottom outlet where the vessel has such an outlet; equalising the temperature throughout the melt; and stirring to help disperse alloying additions uniformly in the melt. Usually an inert gas is used, e.g. argon. Reactive gases are sometimes substituted if the melt needs some particular chemical treatment such as deoxidising.

Previous gas injection proposals have included the provision of a solid porous plug or brick in the refractory lining of the vessel wall or bottom. Installations featuring porous plugs may be simple, but they possess various drawbacks.

For example, dimensional variations in component parts of a gas-injecting system can lead to loss of gas whereby insufficient gas may reach the porous plug, or excessive quantities of gas may have to be supplied to compensate for the losses.

Also, for example, it is known that the vessel lining may lift-off from the vessel shell between filling and emptying the vessel. Such lift-off is apparently caused by different thermal expansions of the lining and the vessel shell. Lift-off creates a gap between the shell and the adjacent refractory, the gap for instance being of the order of 15 mm. Lift-off is an especial problem with dolomite linings, but is not confined to such linings. A consequence of lift-off can be loss of gas. Thus, insufficient gas may ultimately reach the vessel contents via the porous plug, or excessive amounts of gas must be used to compensate for that which is lost. Lift-off may also disturb the seating of the plug in the lining, resulting in a potential hazard of leakage of melt from the vessel.

Further, porous plugs are potentially hazardous, inter alia because they may crack due to thermal shock when molten metal is introduced into the vessel. Failure of the plug can obviously have extremely dangerous consequences.

The present invention aims to overcome drawbacks associated with prior gas injection systems, and to provide safe, cost effective equipment for use in gas injection and to minimise or prevent loss of gas through leakage.

The invention aims, inter alia, to provide a substantially gas tight gas-injection system having improved means to convey gas positively to the injection plug means; the gas-conveying means is desirably adjustable to compensate for dimensional variations.

In another aspect, the invention aims to provide a gas conveying means able to cope with the occurrence of lift-off, yet still able to convey gas positively to the injection plug means.

The invention also aims to provide gas injection equipment which is capable of containing melt leakage caused by failure of the plug itself or of its seating in the vessel wall.

In this invention, gas is conveyed to molten metal via a refractory nozzle block having a passage therein, the passage being closed, or including a plug closure, at the discharge end of the nozzle passage; the closure or plug is porous, foraminous or is traversed by capillary passages, for distributing the gas into the metal. To minimise or prevent loss of gass through leakage, a gas duct enters the nozzle passage and leads direct to the closure or plug; the duct in some embodiments is adjustable in length, e.g. to accommodate dimensional variations in components of the gas injection system. Since, moreover, the nozzle block may tend to be lifted in its seating in the vessel wall, certain embodiments of this invention are designed to include a gas duct that is expansible, and hence is capable of ensuring there is always a positive feed of gas, direct to the closure or plug, in the event of lift-off occurring.

To contain potential melt leakages past or through the plug or closure, the invention provides a particulate or fibrous refractory element inside the nozzle. The said element can be in the form of a cartridge, e.g. of annular form, enclosing the gas duct leading to the plug or closure. An especially beneficial cartridge element embodying the invention has a particulate filling and a disintegratable cartridge wall. The disintegratable wall is such as to disintegrate by melting or burning away after the vessel has been filled, so as to release the particulate filling. The latter will then settle in the nozzle passage and ensure the entire transverse cross-section thereof is occupied by the particulate material. The settled particulate material can then serve as a block for melt which may enter the passage, to prevent the melt from escaping from the passage.

The invention also provides a cartridge for use in gas injection comprising an open-ended annular body or sleeve of fibrous refractory material, and inside the central part of the body or sleeve is a filling of particulate refractory matter held in place in the body or sleeve between compressible wads of fibrous refractory material, the particulate matter and fibrous wads being permeable to gas flow and impermeable to liquid flow therethrough. In use, should liquid, such as molten metal, traverse the closure or plug of the associated nozzle body, this cartridge can prevent a serious leakage of said liquid from the nozzle passage.

Gas injection apparatus according to the present invention can include ducting exteriorly of the vessel for conveying gas to the nozzle, the ducting including two abutting orificed metal or refractory bodies, one of the bodies being movable relative to the other to place the orifices out of registry thereby to close the ducting and prevent any molten metal which might enter the nozzle from escaping from the vessel via the nozzle and ducting.

The invention also provides a method of metal pouring employing injection apparatus as outlined in the last preceding paragraph and a teeming apparatus disposed also in a wall of the vessel, wherein gas is injected into the molten metal in the vessel through the gas injection means simultaneously with teeming the metal from the container via the teeming means. The gas injection means can be located adjacent the vessel bottom in its side wall, but will usually be located in the vessel bottom, as will the teeming means.

Preferably the means to control teeming is a sliding gate valve, although it could be a stopper rod arrangement.

Figure 8:
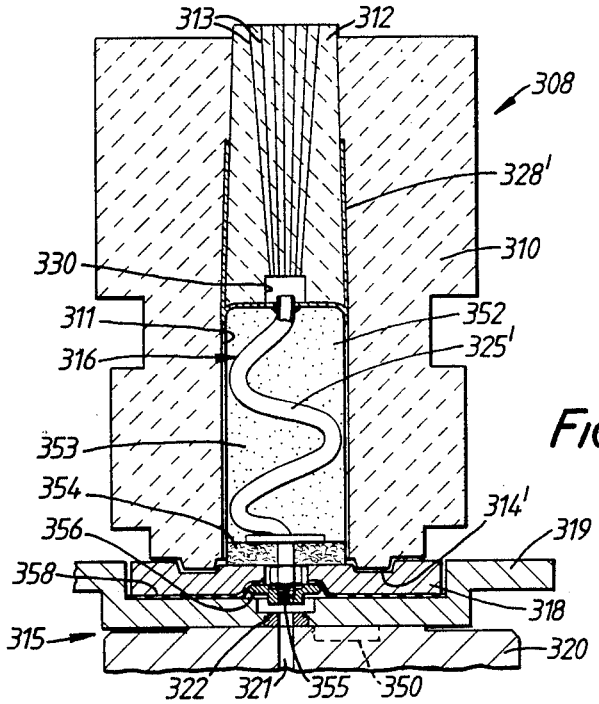
Figure 9:
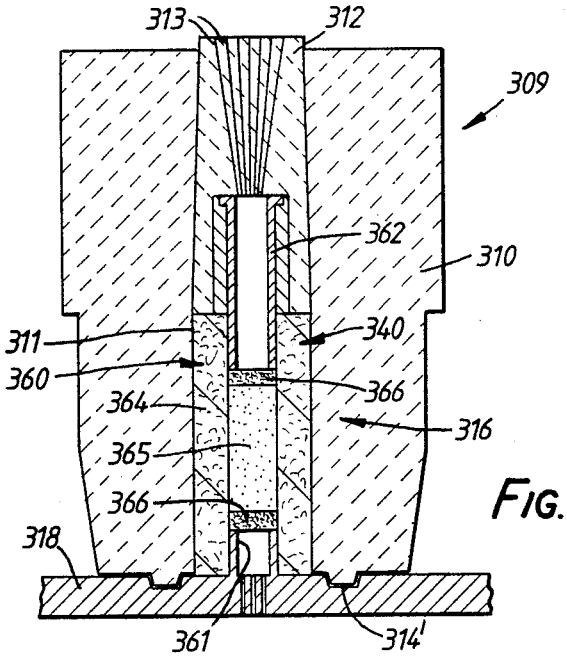
Figure 10:
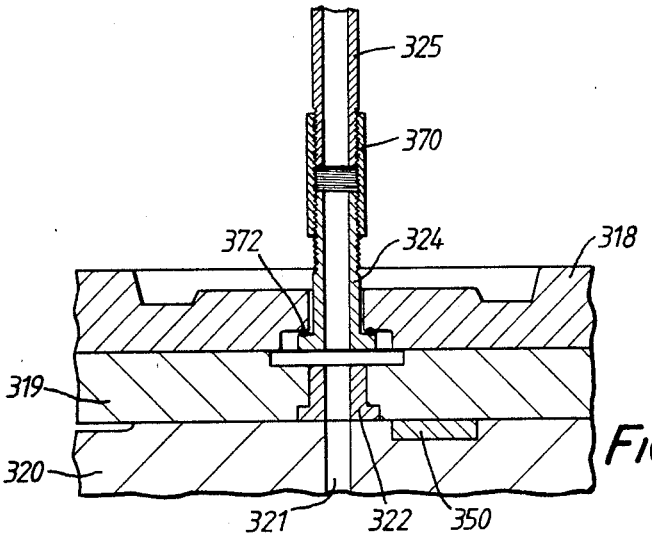
Figure 11:
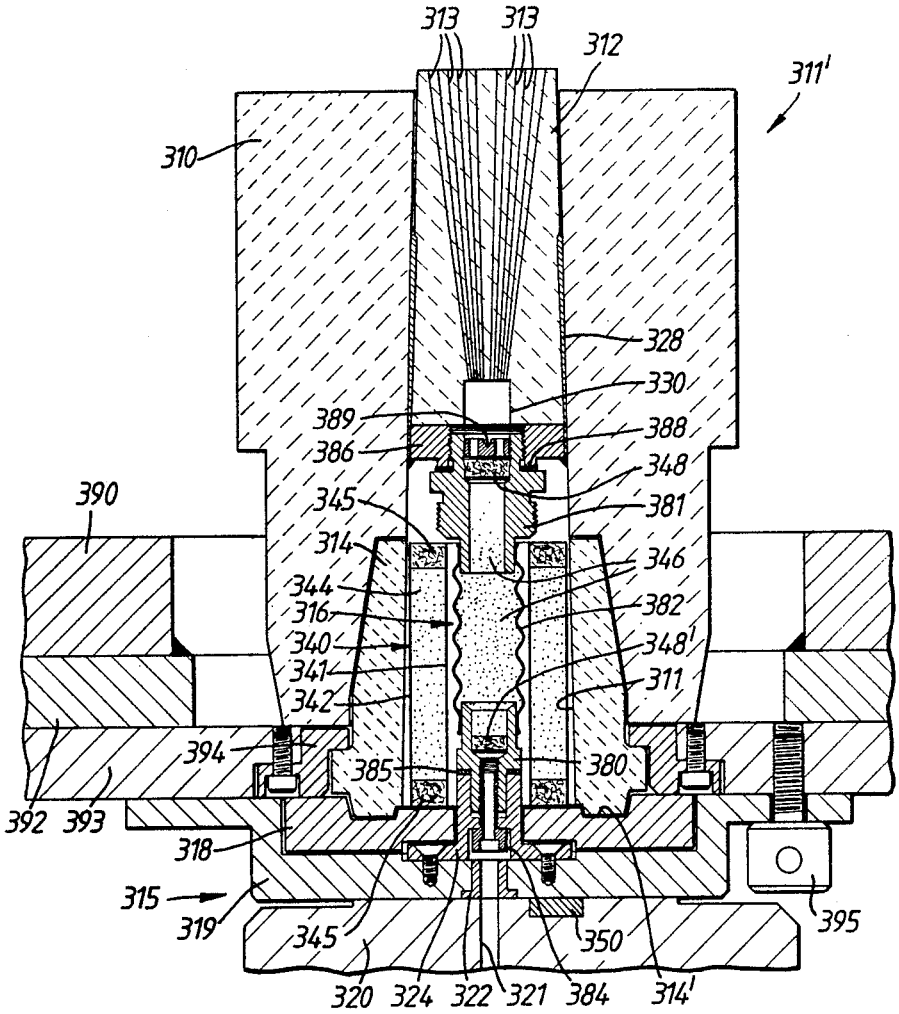
Figure 12:
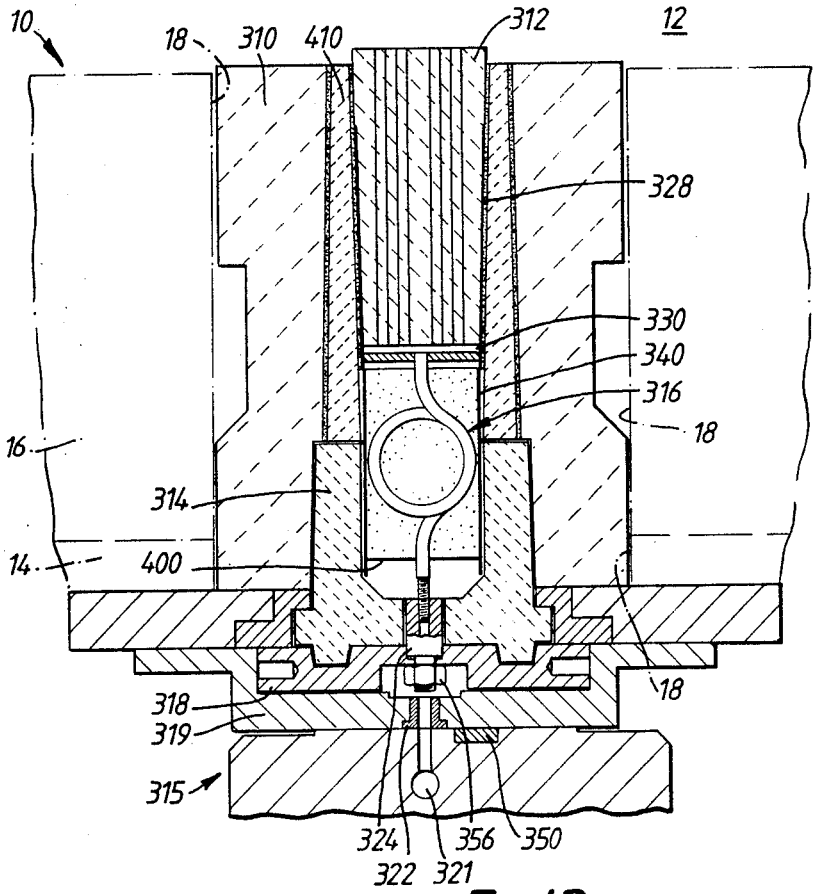
Figure 13:
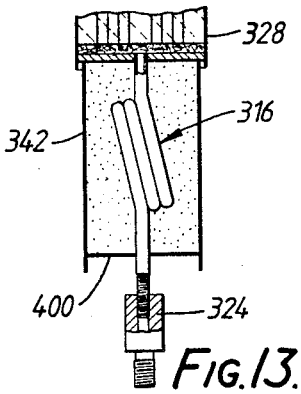

Embodiments of the invention will now be described in more detail by way of example with reference to the accompanying drawings, in which:

FIGS. 1 to 9 and 11 are longitudinal cross-sectional views through ten embodiments of gas injection apparatus featuring aspects of the invention, FIG. 10 is a fragmentary cross-sectional view of a gas conveying duct useable in apparatus according to the invention, FIG. 12 is a longitudinal cross-sectional view through a further gas injection apparatus featuring aspects of the invention, and FIG. 13 is a fragmentary view of part of the apparatus shown in FIG. 12, viewed at right angles to the illustration of FIG. 12.

Figure 4:
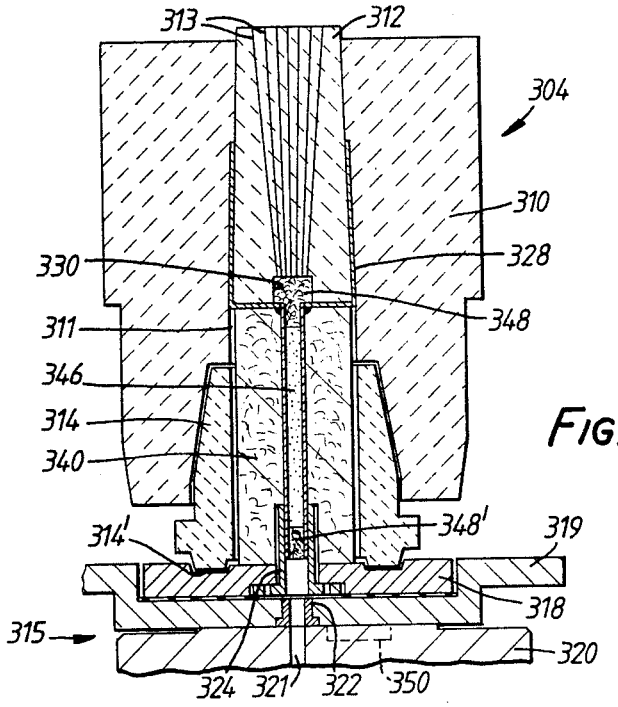
Figure 5:
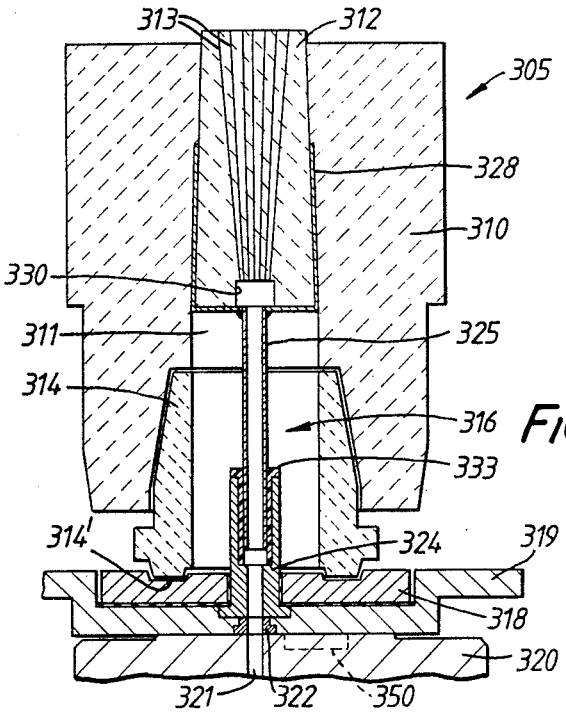
Figure 6:
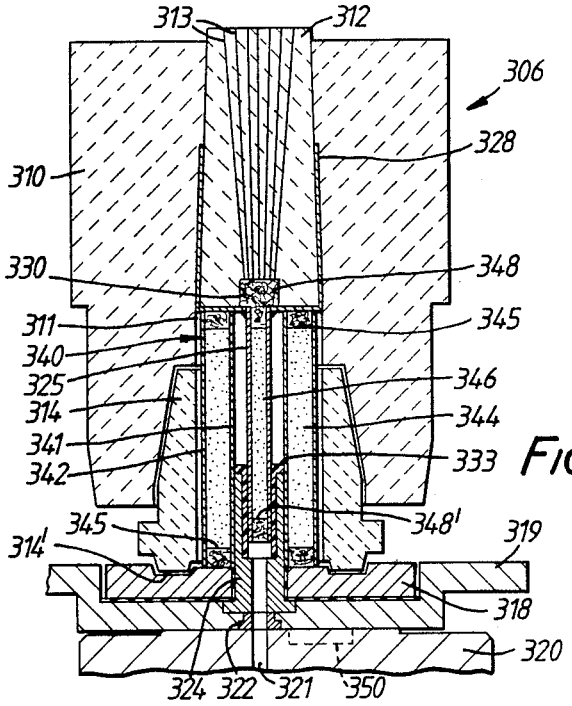
Figure 7:
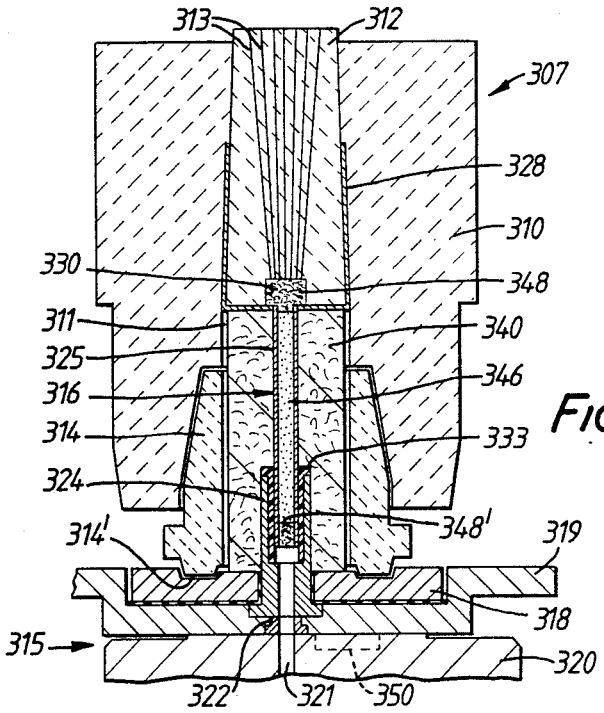

The embodiments of this invention as shown in the accompanying drawings can be incorporated in gas injection apparatus shown in FIGS. 5 to 7 of our pending Int. Appln. No. PCT/GB88/00091 to which reference is hereby directed. The injection apparatus can be used in conjunction with a teeming control apparatus, such as a sliding gate valve, as shown in FIG. 4 of the said patent application, when the user will be able to teem molten metal from a vessel such as a ladle or tundish simultaneously with the injection of gas into the metal.

FIGS. 1 to 9 of the accompanying drawings show longitudinal sections through gas injection devices according to the invention. Like parts in the drawings are given the same reference numbers for convenience. The devices are to be installed in the wall 10, e.g. the bottom of a molten metal vessel 12. For simplicity, the wall 10 of the ladle or tundish vessel 12 is shown diagrammatically, only in FIG. 12 hereof. The wall 10 comprises a metal shell 14 and a refractory lining 16, which—as described hereinbefore—may tend to lift off from the shell 14.

The shell and lining have registered openings 18 therein in which a gas injection nozzle block is seated. The block will ordinarily be cemented into the opening 18, e.g. by cement applied to an inner end of the block, i.e. its upper end as viewed in FIG. 12.

The several embodiments 301 to 309 of the injection devices shown in FIGS. 1 to 9 all include a gas injection nozzle block 310 made of refractory material, e.g. a castable concrete. Each nozzle block 310 has a central passage 311 defined therein, and each block will, in use, be secured and e.g. cemented as indicated above in the insulating lining of the vessel. Blocks 310 are closed at their gas discharge ends by gas-porous or foraminous end sections 312 through which gas is delivered to molten metal in the vessel. The end sections could be an integral part of the nozzle block 310 but preferably, as in the illustrated examples, separate plugs form the closing end sections 312. Plugs 312 are refractory members pierced by capillary bores 313. The plugs 312 taper inwardly towards the vessel interior and the passages 311 are similarly tapered at least in their downstream portions. The plugs 312 are cemented in place.

It is not essential for the plugs to taper inwardly in the direction of the vessel interior, and FIG. 12 shows an embodiment having the opposite taper.

The plugs 312 or integral closing means are intended to pass gas but to prevent molten metal entering the passage 311 and thereby escaping from the vessel.

As shown in FIGS. 1 to 7, the upstream end of each nozzle block has an inset, refractory insert ring 314 partially defining the passage 311. The insert ring 314 is cemented into the nozzle block 310 and has an encircling rib 314' in its outer end face. The rib 314' enables other components of the device, by which gas is delivered to the nozzle block, to be appropriately aligned therewith. Ring 314 can be omitted, however, as will appear from FIGS. 8 and 9. In these figures, the nozzle blocks 310 have outer end faces furnished with encircling ribs 314' for aligning the said other components therewith.

The other components form part of a gas delivery means provided to convey gas from a source (not shown) into the nozzle block for ejection into the molten metal.

The gas delivery means comprise an external part 315 (outside the vessel wall) and an internal part 316 located primarily within the nozzle block 310.

The external part 315 of the gas delivery means includes a plate 318 made of refractory, steel, or steel with a refractory insert disposed in or on the upper surface thereof in part defining an orifice in plate 318, a metal holder 319 and a feed block 320, all serially arranged and disposed in operative sealing contact one with another. The plate 318 is located in a recess in the holder 319 and the latter is suitably secured, immovably, to the vessel wall. The feed block 320 is, however, laterally displaceable relative to the holder 319 for the reason given hereafter. Feed block 320 has a gas passage 321 therein, connectible by means not shown to the source of gas. To permit gas injection, the block 320 is so positioned that passage 321 is aligned with coincident orifices in the plate 318 and holder 319, and with the internal part 316 of the gas delivery means.

The feed block 320 and the holder 319 have flat confronting surfaces, and the former is biased, for instance by springs not shown, against the holder. The arrangement is such that when pressurized gas is fed to the passage 321, it will pass into the coincident insert bush 322 set in the orifice of holder 319 and will not leak to any substantial extent along the interface between the block 320 and holder 319.

From insert 322, the gas will enter the internal part 316 of the gas delivery means. The internal part in FIGS. 1 to 7 includes a union 324 located in the orifice of plate 318 and a gas pipe 325 extending from the union to the closure plug 312 inside the nozzle block.

To prevent gas escaping along the interface between the plate 318 and the recess in holder 319, a sealant or gasket 326 is placed at the interface. The constructions of the injection devices illustrated in FIGS. 1 to 9 are such that gas leakage via the joint between the plate 318 and the nozzle block 310 or insert ring 314 is virtually impossible, but if desired the joint can include a mastic or cementitious sealant.

The gas pipes 325 shown in FIGS. 1 to 7 are each welded, brazed or screwed to a metal jacket or can 328 tightly encasing the closure plugs 312 except for their downstream end portions. An aperture in the base of each can permits gas to exit the pipe directly into a plenum 330 formed in the associated plug 312 at the upstream end thereof. The capillary passages 313 open to the plenum 330 to receive gas therefrom. At their lower ends, the pipes are screw-threaded to the unions 324 (FIGS. 1 to 4), or are telescopically received therein (FIGS. 5 to 7). A suitable sealant or gasket may be incorporated between the unions 324 and pipes 325, and in the case of FIGS. 5 to 7 a gasket sleeve 333 is sandwiched between the pipe and the union, and is located in a counterbore in the latter.

The unions 324 in FIGS. 1 to 4 are substantially identical and have a flange 332 adapted to be rotated by a wrench for securing the screw-threaded pipe and union together. The flange is seated in a recess in the plate 318. If necessary or desirable, a sealant or gasket may be located between the union and the plate 318 for gas tightness.

Thanks to the screw-threaded connection between the pipes 325 and unions 324 of the embodiments of FIGS. 1 to 4, the length of the internal part 316 of the gas delivery means can be adjusted to accommodate dimensional and/or positional variations in the components, and especially the refractory components, of the gas injection system. If is, for instance, likely in practice there will be variations in the distance between the base of the nozzle plug or closure, and the underside of the plate member 318, from apparatus to apparatus.

In the modification shown in FIGS. 5 to 7, the union need not be rotated for securing it and the pipe together, and in this instance its flange is seated in a recess in the holder 319. If the plate 318 is made of metal, the union could be screwed thereto.

Thanks to the telescopic interfit between the pipes 325 and unions 324 of the embodiments of FIGS. 5 to 7, the length of the internal part of the gas delivery means is not fixed and hence can accommodate dimensional and/or positional variations as aforesaid. Moreover, these embodiments are well adapted to suit situations where lining lift-off is possible.

It will be appreciated from the foregoing that the gas delivery means, from passage 321 to plenum 330, is substantially gas tight.

In service, it is conceivable that the plugs 312 might fail, or the joint between them and the nozzle blocks 310, so that molten metal might enter the passages 311 after melting through the cans 328. As a safety measure to guard against such an unusual eventuality, the passages 311 are not usually left empty as shown by way of illustration in FIGS. 1 and 5. The spaces around the pipes 316 inside the passages will usually be occupied by a packing element 340 which should obstruct dangerous outflow of metal.

Figure 2:
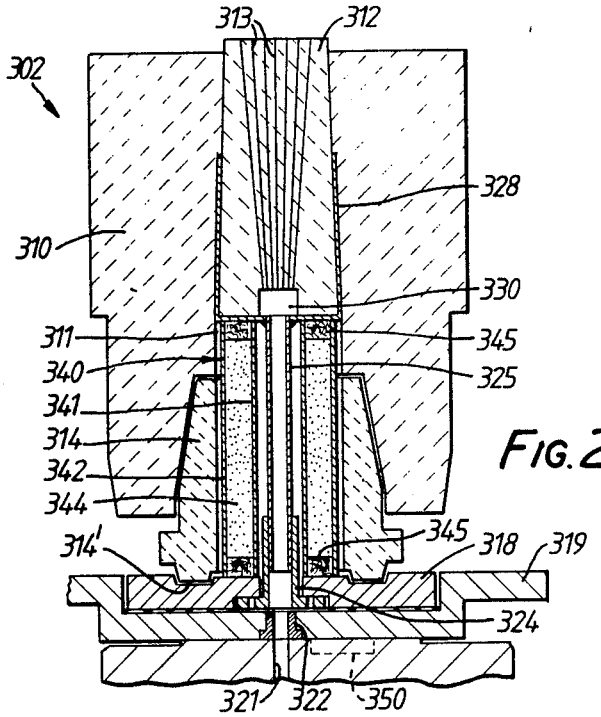
Figure 3:
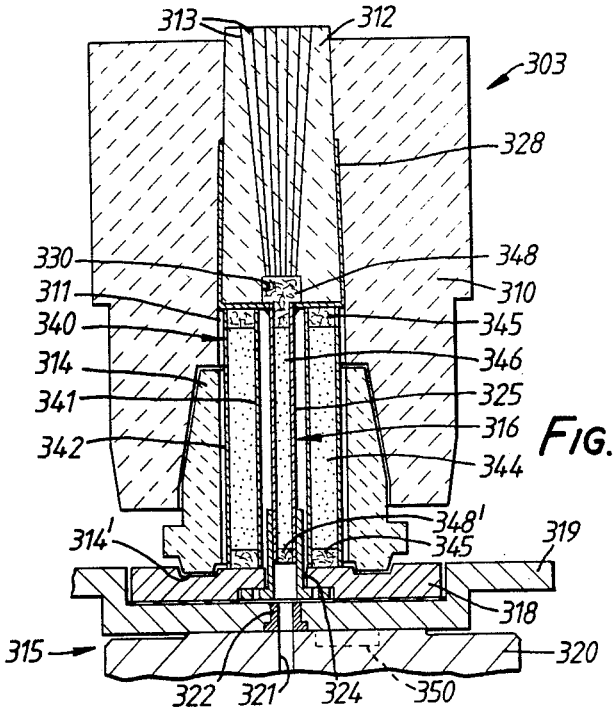

The packing element 340 shown in FIGS. 2, 3 and 6 is an annular cartridge having inner and outer cylindrical walls 341, 342. A granular refractory packing 344, e.g. a refractory sand, is disposed between the walls 341, 342 and is held in place by refractory wads 345 of compressible material, e.g. KAOWOOL (RTM). This material is made by Morganite Ceramic Fibers Limited. The wads 345 may initially stand proud of the walls 341, 342 at the ends of the packing element 340, so as to be compressed when the injection equipment is assembled and prepared for injection.

The packing element shown in FIGS. 4 and 7 is a thick-walled sleeve of fibrous refractory material, e.g. FIBERFRAX (RTM). This is a mineral wool material marketed by Corundum Limited. Another possible material is REFRASIL (RTM) Batt BA-1M manufactured by Chemical and Insulating Company of Darlington, U.K.

If desired, the internal part 316 of the gas supply means can be filled with a melt-impermeable but gas-permeable packing. See FIGS. 3, 4, 6 and 7 where the packing comprises granular refractory e.g. sand 346 held in place by refractory fibrous wads 348, 348' e.g. of KAOWOOL. By way of example, wads 348 are shown filling the plenums 333 in these Figures, but they could be confined to the pipes 325 if preferred.

The packing elements 340 and packings in the pipe 325 (if provided) will hinder flow of melt from the vessel, and is anticipated that melt entering the packings will freeze therein, thus preventing a dangerous breakout.

At the end of an injection, or in the event that a failure of the closure plug is suspected, it is possible to displace the gas feed block 320, manually, mechanically or hydraulically, so as to move its passage 321 out of registry with the orifices in the plate 318 and holder 319. When so displaced, any risk of melt entering passage 321 is precluded, e.g. after flow along the pipe 325. The feed block 320 can optionally have an insert disc 350 located therein, to be placed across the insert bush 322 when the block 320 is displaced. If the disc has a high heat conductivity, any melt that might contact with it should quickly freeze, thus precluding outflow of melt.

Another embodiment 308 of the invention is shown in FIG. 8. In this case, the plug is encased by a metal sleeve 328' having no base, and the pipe 325' is part of a cartridge member 352. Cartridge member 352' is shown as an inverted metal can filled with a granular refractory packing 353, e.g. sand, which is held in place by a wad of fibrous refractory material 354, e.g. KAOWOOL. The gas pipe has a helical or tortuous form and extends from the top of the cartridge can (to which it is welded) to a screw-threaded inlet end 355. The inlet end 355 extends into the orifice of plate 318 and a clamp nut 356 is screwed thereto, the nut being located in recesses in the confronting surfaces of the plate 318 and holder 319. For ensuring gas tightness, a gasket or sealant 358 may be sandwiched between the nut 356 and the refractory plate.

The length of the inner duct part 316 defined by pipe 325' can be varied to accommodate dimensional variations, thanks to the helical or tortuous form of the pipe. Moreover, in this construction the pipe can give, and extend, if lift-off occurs thus to maintain a direct gas flow path from the external duct part 315 to the plenum 330.

Should melt intrude into the cartridge member 352, the particulate packing 353 should safely contain the melt, which can be expected to freeze within the packing.

Apparatus 309 shown in FIG. 9 is yet another embodiment of the invention. The internal duct part 316 of the gas supply means now comprises a refractory composite cartridge 360, a spigot 361 on the plate 318 and a feed tube 362 depending from the plug 312. The cartridge 360 comprises an annular fibrous refractory member 364 e.g. FIBERFRAX closely fitting in the passage of the nozzle block, and a gas-permeable but melt-impermeable packing located internally of the annular member 364. The packing 365 comprises granular refractory e.g. sand located between wads 366 of fibrous refractory e.g. KAOWOOL. The packing is compressed between the spigot 361 and feed tube 362. The feed tube 362 is cemented into a counterbore in the plug 312.

Composite cartridges 360 as employed in the embodiment of FIG. 9 are compressible longitudinally. Thus, once again they can tolerate and accommodate dimensional variations.

In the embodiments of FIGS. 1 to 7, the feed pipe 325 was screw-threaded or telescopically coupled to the union 324. Another version is shown in FIG. 10. Here, both the pipe and union are externally threaded and an internally-threaded joining sleeve 370 is provided to secure one to the other. The sleeve 370 could be screwed fully onto the pipe 325 and the union 324 could then be screwed into the joining sleeve 370. A thread sealant can be employed, if desired. It will be observed that a gasket ring 372 is compressed between a flange of the union 324 and the plate 318. Such a gasket ring 372 can be utilised in any of the embodiments of FIGS. 1 to 8.

The injection apparatus 311' shown in FIG. 11 is similar in most respects to the apparatus 301 to 309 described hereinbefore. An annular cartridge type of packing element 340 is disposed in the passage 311 of nozzle block 310, element 340 being as described in relation to FIGS. 2, 3 and 6. The internal part 316 of the gas supply means differs from previous embodiments.

In this apparatus, the internal part 316 comprises an inlet member 380, an outlet member 381 and a flexible, corrugated bellows pipe 382. The inlet member 380 is telescopically received in the union 324 and is secured thereto by a hollow bolt 384; gas from the external part 315 of the supply means will pass up through the bolt 384 into the inlet member and hence into pipe 382. A metal seal 385 is clamped between confronting end and shoulder surfaces of the union and inlet member respectively. The outlet member 381 is screw-threaded into a central opening in a thick base 386 of the can 328, for conveying gas from pipe 382 into the plenum 330. A metal seal 388 is clamped between the outlet member 381 and the base 386. The corrugated pipe 382 is welded, brazed or otherwise secured at its ends to the members 380, 381. The interior of the pipe 382 and interiors of the members 380, 381 are packed with granular refractory 346 held in place by wads of fibrous refractory 348, 348', and superimposed over the fibrous refractory 348 in outlet member 381 is a perforated plug 389 screwed into the end of the said member.

Apparatus 311, as well as previously described embodiments 305, 306, 307 and 308 are well adapted to accommodate dimensional variations and to tolerate tendencies for the nozzle block 310 to lift with the lining in service.

FIG. 11 also shows the typical way in which the injection apparatus is fitted to the shell 390 of the vessel. Thus, an adapter plate 392 is secured to the wall and a mounting plate 393 is secured to the adapter plate e.g. by bolts, not shown. The mounting plate 393 has an orifice into which is fixed a seating ring 394 for locating on the nozzle block 310 or insert ring 314. The holder 319 is screwed to the mounting plate 393 by screws 395, but one of which is shown in FIG. 11.

As a further safety measure, a refractory plug pierced by capillar gas passages may be optionally fitted into the unions 324.

From the foregoing, it will be seen that we have provided a gas-tight coupling from the gas inlet of the device to the gas-porous discharge element or plug and a cartridge element for protection against leakage of molten metal.

When injection is stopped, the passages 313 may become blocked by molten metal. The component containing these passages may need replacing before another molten charge can be injected. For this reason and on cost grounds, it is preferred that the passages 313 are provided in a removable plug 312 rather than in an integral closure of the nozzle. Removal of the tapered plug 312 is aided by the pipes 325, 382 which can be used to exert an adequate withdrawal force on the plug. Because the plugs have to be replaced, and due to the desire to have gas tight feeds to the plugs, the gas feed arrangements should be capable of adapting to the inevitable dimensional variations found in otherwise identical gas injection installations. The gas feed arrangements should, in some cases, be adequately extensible so as to remain effectively gas-tight in a lift-off situation.

Yet another embodiment suitable where lift-off is likely is shown in FIGS. 12 and 13. Here, the inner duct part 316 is welded at one ehd to the base of a can 328 of the plug 312, and is screw threaded, or welded, to a union or inlet 324 at its other end. The union is clamped to plate member 318 by a nut 356 as in the embodiment of FIG. 8. Inner duct part 316 is a coiled metal pipe. The coil comprises one or several turns (two turns being illustrated). The coil axis is transverse to the nozzle passage, and is tilted somewhat as seen in FIG. 13 to enable the ends of the duct to extend axially to the base of the can and to the inlet 324. Thanks to the coil, and the inherent elasticity of the pipe, the duct 316 can give to accommodate dimensional variations, and also to accept lift-off without loss of gas tightness between the inlet 324 and the plenum 330.

In this embodiment, the nozzle passage 311 through which the duct 316 extends contains a cartridge 340 having an enclosing wall 342 and a base 400. The cartridge contains a particulate refractory packing, e.g. of sand.

As in previous embodiments, appropriate sealing means can be located between (a) the inlet 324 and the plate member 318, (b) the latter and the ring member 314, and (c) the plate member 318 and the holder 319. The external duct arrangement 315 can be substantially as in previous embodiments.

The embodiment shown in FIG. 12 demonstrates other features which can be incorporated in practising this invention. Thus, the nozzle 310 has a passage 311 which diverges towards the vessel interior. The plug 312 is correspondingly tapered. The nozzle block 310 is a composite structure consisting of the main block body, insert ring 314 defining an outer part of the nozzle passage 311 and a liner defining an inner part of the passage. The liner 410 is a highly refractory member and provides the divergent passage part in which the plug 312 is cemented.

It will be noted from FIG. 12 that the bottom end of the plug 312 is spaced from the base of the can 328, thus forming a plenum into which the coiled pipe 316 feeds gas. The plenum optionally contains a fibrous refractory as FIG. 13 shows.

In the embodiment of FIGS. 12 and 13, the plug 312, pipe 316 and cartridge 340 will ordinarily be supplied to customers as a unit. The cartridge enclosing wall 342 may be a jam fit with a lower end portion of the can 328 or may be secured thereto in any other convenient way. The cartridge base 400 can be a metal or plastics disc or lid, apertured for the pipe 316 to extend therethrough.

The embodiment of FIG. 8 can have its plug 312, pipe 325' which is coiled about an axis generally coaxial with the passage, and cartridge 352 preassembled as a ready-to-fit unit like the embodiment of FIGS. 12 and 13.

The cartridge elements disclosed hereinbefore represent a safety feature. They are provided in case melt should manage to pass the plug and enter the passage. This might happen if the plug, or the joint between the plug and the nozzle body were to degrade and become defective. The cartridge elements are intended to contain such passage-invading melt and prevent a dangerous break-out. Melt entering the cartridge should freeze therein before it can reach the exterior of the apparatus.

The preferred cartridges are those having a filling of particulate refractory material, and are illustrated in FIGS. 2, 3, 6, 8, 11, 12 and 13.

The said cartridges are cylindrical, or annular; they have outer walls—and inner walls too when the are annular. Their interiors are filled with particulate refractory material which can include a sand, or a sand and graphitic material, inter alia. The particulate fillings are retained in their cartridges by closures at the ends of the cartridge elements. Such closures comprise packings of fibrous refractory wadding. See FIGS. 2, 3, 6 and 11. In FIG. 8, however, the closures comprise (a) such a fibrous packing and (b) the base part of a metal can (328') which partially encases the plug element (312). In FIGS. 12 and 13, the closures are (a) the cartridge base (400) and (b) the base of the can (328).

For these cartridges, it is beneficial for the outer wall at least to be made of a material which disintegrates at the subsisting service temperatures inside the passage, which may be of the order of 600°–650° C. In the case of an annular cartridge, preferably both its radially outer and inner walls are made of such a disintegratable material. By having thermally-degradable walls, cartridges according to the invention can, of their own accord, release their particulate fillings upon disintegration of their walls. The fillings can then settle in the nozzle passage and ensure the entire transverse cross-section of the passage is occupied by particulate material. Release of the particulate material will thus result in filling any gaps or clearances that were left between the passage wall and the cartridge and/or between the latter and the pipe 316, when initially installed. Therefore, these cartridges will be very efficacious in containing any melt which might escape past the plug and enter the passage, thanks to the manner in which they can "collapse" so as to present a total blockage of the passage for capture of passage-invading melt.

The wall material can be such as to disintegrate by melting, charring or completely combusting at the temperatures to which it is exposed inside the nozzle passage. The said material could be a thin gauge, low-melting point metal e.g. aluminium or lead. It could be a plastics material. The presently preferred wall material, however, is made of paper, paper-board or the like paper-based product. Such a material is inexpensive, leads itself to easy manufacture of a durable cartridge, and will reliably char or burn away to release the particulate filling.

It is to be understood that the constructions shown in the drawings and described hereinbefore are illustrative only and that modifications can be and will no doubt be made by the ordinarily-skilled addressee, without departing from the scope of the invention hereby disclosed.

INDUSTRIAL APPLICABILITY

The injection equipment disclosed herein is applicable to the introduction of gases into molten metals contained in vessels such as ladles, and to safety measures in relation thereto. The molten metals can be ferrous or non-ferrous, and the injectant gases can be employed to achieve thermal and/or compositional uniformity of the melt before it is poured from the ladle, or to change its chemical composition.

We claim:

1. An injection nozzle for installation in a wall of a vessel, for use in introducing gas into liquid contained therein, the nozzle comprising a body pierced by a passage which is terminated at a discharge end of the nozzle by a gas-porous or foraminous passage-closing means, the nozzle including means gas-tightly affixed to the closing means to feed gas thereto, and the gas-feeding means including a duct structure which extends along the passage between the closing means and an inlet end of the body, the duct structure providing a substantially leak-tight gas-feed path from an external gas delivery means to the passage-closing means, and the said structure being adjustable or extensible in length.

2. A nozzle according to claim 1, wherein the duct structure includes a particulate, gas-porous filling through which gas is fed to the closing means.

3. A nozzle according to claim 1, wherein a space within the passage surrounding the duct structure includes a filling selected from particulate and fibrous refractory materials.

4. A nozzle according to claim 3, wherein the refractory filling comprises a cartridge element.

5. A nozzle according to claim 4, wherein the cartridge element has a particulate filling contained by a cartridge wall, and the said wall is thermally disintegratable for releasing the filling upon disintegration.

6. A nozzle according to claim 1, wherein an apertured gas-impervious member is gas-tightly associated with the closing means to form a gas inlet thereto, and the duct structure is gas-tightly coupled to the apertured member.

7. A nozzle according to claim 1, wherein the duct structure comprises a union element and a metal pipe element, the latter fastened gas-tightly at one end with the closing means and adjustably connected at its other end to the union element for receiving gas from an external gas delivery means.

8. A nozzle according to claim 7, wherein the pipe element and union element are adjustably interconnected whereby the length of the duct structure comprising these two elements is adjustable.

9. A nozzle according to claim 1, wherein the duct structure includes a pipe element of a sinuous or coiled form capable of being extended by virtue of its form.

10. A nozzle according to claim 1, wherein the duct structure includes a pipe element of corrugated form capable of being extended by virtue of its form.

11. A nozzle according to claim 1, wherein the duct structure is defined by an annular refractory fibrous sleeve and by first and second tubular elements, the first gas-tightly coupled with the closing means and the second serving as an inlet to said structure, the tubular elements being telescopingly received in the ends of a passage defined by the sleeve, and the passage containing a particulate filling held in place by wads of compressible fibrous refractory material, the length of the duct structure comprising the sleeve and tubular elements being variable by virtue of the compressibility of the said wads.

12. A nozzle according to claim 11, wherein the sleeve, its filling and the compressible wads constitute an expendable passage-filling cartridge.

13. A nozzle according to claim 1, wherein the closing means has at least one capillary passage in use to convey gas to the liquid, and said at least one passage extends from a discharge end of the closing means to a plenum adjacent its opposite end.

14. A gas injection nozzle, for installation in the wall of a vessel and for use in injecting gas into a liquid contained therein, comprising a refractory nozzle body having a passage therein and a gas porous or foraminous closing means closing the passage at a discharge end of the body, a gas supply duct structure extending from the said closing means along the passage to an inlet end for operative connection to a gas supply, and closely fitted in the passage about the duct structure is a cartridge containing a filling of particulate refractory matter, the cartridge having a filling-retaining wall which is thermally disintegratable whereby, upon disintegration in use, the particulate filling is released to settle in the passage and completely block the passage against leakage of liquid which may enter the passage.

15. A gas injection apparatus including a nozzle according to claim 1, and further including external gas delivery means in operative, gas-tight juxtaposition with the duct structure for conveying gas thereto from a supply, the external means including a stationary body, a movable body and means to bias the latter into gas-tight, slidable contact with the former, the bodies having orifices therein which, in a first position of the movable body are registered for supplying as into the duct structure and closing means and, in a second position thereof are out of registry for shutting off the supply of gas, the movable body preferably having an insert sleeve defining its orifice and an imperforate insert positioned therein to register with the orifice of the stationary body when the movable body is moved to its second position, the or each insert where provided being made of highly thermally conductive materials.

16. A gas injection apparatus including a nozzle according to claim 14, and further including external gas delivery means in operative, gas-tight juxtaposition with the duct structure for conveying gas thereto from a supply, the external means including a stationary body, a movable body and means to bias the latter into gas-tight, slidable contact with the former, the bodies having orifices therein which, in a first position of the movable body are registered for supplying gas into the duct structure and closing means and, in a second position thereof are out of registry for shutting off the supply of gas, the movable body having an insert sleeve defining its orifice and an imperforate insert positioned therein to register with the orifice of the stationary body when the movable body is moved to its second position, the or each insert where provided being made of highly thermally conductive materials.

17. A gas injector for an injection nozzle installed in a wall of a vessel for containing liquid such as molten metal, the injector in combination comprising (i) a gas-porous or foraminous refractory block for use to close a discharge end of a passage of said nozzle and (ii) gas-feeding means affixed in operative, substantially gas-tight relationship with the refractory block, in use for admitting gas to the block for injection into liquid, the gas-feeding means including an elongate duct structure which can be extended or contracted to vary its length yet capable of providing a substantially leak-tight gas feed path to the block.

18. An injector according to claim 17, wherein the duct structure includes a particulate, gas-porous refractory filling through which gas is fed to the block.

19. An injector according to claim 17, wherein an apertured gas-impervious member is gas-tightly associated with the block to form an inlet thereto, and the duct structure is gas-tightly coupled to the apertured member.

20. An injector according to claim 19, wherein the apertured member is the base of a cup-shaped metal can which encases at least part of the length of the block.

21. An injector according to claim 19, wherein the apertured member is a generally tubular fitting gas-tightly affixed to a base of a cup-shaped can which encases at least part of the length of the block.

22. An injector according to claim 17, wherein the duct structure comprises a gas-admission union element and a metal pipe element, said pipe element having its end remote from the block connected to the union element adjustably for varying the overall length of the said structure.

23. An injector according to claim 22, wherein the adjustable connection is afforded by a screw-threaded interengagement between the pipe element and the union or inlet element.

24. An injector according to claim 17, wherein the duct structure includes a pipe element of a sinuous or coiled form capable of being extended by virtue of its form.

25. An injector according to claim 17, wherein the duct structure includes a pipe element of corrugated form capable of being extended by virtue of its form.

26. An injector according to claim 17, wherein the duct structure is defined by an annular refractory fibrous sleeve and by first and second tubular elements, the first gas-tightly coupled with the closing means and the second serving as an inlet to said structure, the tubular elements being telescopingly received in the ends of a passage defined by the sleeve and the passage containing a particulate filling held in place by wads of compressible fibrous refractory material, the length of the duct structure comprising the sleeve and tubular elements being variable by virtue of the compressibility of the said wads.

27. An injector according to claim 17, wherein the closing means has at least one capillary passage in use to convey gas to the liquid, and said at least one passage extends from a discharge end of the closing means to a plenum adjacent its opposite end.

28. An injector according to claim 17, wherein the duct structure is contained within an annular cartridge which contains a filling selected from particulate and fibrous refractory materials.

29. An injector according to claim 17, wherein the duct structure extends through a tubular compartment secured to the block, the compartment having a filling of particulate refractory material.

30. An injector according to claim 28, wherein the cartridge has a thermally disintegratable wall for releasing particulate refractory material contained therein upon disintegrating.

31. An injector according to claim 29, wherein the compartment has a thermally disintegratable wall for releasing particulate refractory contained therein upon disintegrating.

32. An injector according to claim 17, wherein the duct structure includes a coiled metal pipe which by virtue of its coiling is extensible, the pipe being embedded in a particulate refractory material which is contained within an enclosure gas-tightly associated at one end with the refractory block, the pipe being sealingly affixed to the enclosure at the said one end for leak-free discharge of gas to the block and the pipe having its other end affixed in a leak-tight manner to a union member for connection to an external gas delivery means, the enclosure preferably having a thermally degradable peripheral wall disintegratable at elevated temperature for releasing the particulate material.

33. A cartridge for use in a gas injection nozzle passage for protection against metal leakage into the passage, the cartridge comprising an annular body having inner and outer walls with a space therebetween filled with a packing of particulate refractory material, the particulate material being retained in the said space between wads of fibrous refractory material.

34. A cartridge according to claim 33, wherein at least one of said walls is thermally degradable and disintegratable at elevated temperature for releasing the particulate packing.

35. A cartridge for use in a gas injection nozzle passage for protection against metal leakage into the passage, the cartridge comprising an annular shell defining an inner longitudinal passage and made of a fibrous refractory material, and its inner passage having a gas-porous packing of particulate refractory material which is retained in this passage between compressible wads of fibrous refractory material.

36. A cartridge for use in a gas injection nozzle passage to guard against metal leakage into the passage, the cartridge comprising a generally cup-shaped housing and having a resilient, coiled extensible metal duct located therein with its ends projecting substantially axially from the housing, and the duct is embedded in a packing of particulate refractory material which substantially completely fills the cartridge housing.

37. The nozzle of claim 2 including fibrous gas porous wads for retaining said filling.

38. The nozzle of claim 4 wherein said cartridge element is of annular form.

39. A vessel for containing a liquid furnished with an injection nozzle according to claim 1.

40. A vessel for containing a liquid furnished with an injection nozzle according to claim 14.

41. A vessel for containing a liquid furnished with an injection apparatus according to claim 15.

42. A vessel for containing a liquid furnished with an injection apparatus according to claim 16.

43. An injector according to claim 18 including a fibrous gas porous wad for retaining the filling in the duct structure.

* * * * *

UNITED STATES PATENT AND TRADEMARK OFFICE

CERTIFICATE OF CORRECTION

PATENT NO. : 4,944,496

DATED : July 31, 1990

INVENTOR(S) : ANTHONY THROWER, JOHN R. GELSTHORPE

It is certified that error appears in the above-identified patent and that said Letters Patent is hereby corrected as shown below:

On the title page:
At 54 in the title before "apparatus" insert --Devices and--.

Column 11 line 24, change "as" to --gas--.

Signed and Sealed this

Twenty-fifth Day of February, 1992

*Attest:*

HARRY F. MANBECK, JR.

*Attesting Officer*

*Commissioner of Patents and Trademarks*